US007473143B2

(12) United States Patent
Chen

(10) Patent No.: US 7,473,143 B2
(45) Date of Patent: Jan. 6, 2009

(54) LOW PROFILE ELECTRICAL CONNECTOR

(75) Inventor: Chien-Chiu Chen, Taipei (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/790,088

(22) Filed: Apr. 23, 2007

(65) Prior Publication Data

US 2008/0057795 A1 Mar. 6, 2008

Related U.S. Application Data

(63) Continuation-in-part of application No. 11/440,445, filed on May 25, 2006, now abandoned.

(30) Foreign Application Priority Data

Nov. 18, 2005 (TW) ..... 94220029 U

(51) Int. Cl.
*H01R 13/625* (2006.01)

(52) U.S. Cl. ..... 439/670

(58) Field of Classification Search ..... 439/607, 439/79, 80

See application file for complete search history.

(56) References Cited

U.S. PATENT DOCUMENTS 5,984,725 A * 11/1999 Belopolsky et al. ..... 439/607
6,007,381 A * 12/1999 Ando et al. ..... 439/607
6,416,358 B1 * 7/2002 Kamarauskas et al. ..... 439/607
6,447,311 B1 * 9/2002 Hu et al. ..... 439/108
6,793,531 B1 * 9/2004 Zhang ..... 439/607
6,955,568 B1 * 10/2005 Wu ..... 439/660
7,037,135 B2 * 5/2006 Chen et al. ..... 439/607
2003/0199197 A1 * 10/2003 Yu et al. ..... 439/607
2004/0180577 A1 * 9/2004 Zhang ..... 439/607
2006/0040555 A1 * 2/2006 Chen et al. ..... 439/607
2006/0105630 A1 * 5/2006 Zhang et al. ..... 439/607

* cited by examiner

*Primary Examiner*—T C Patel
*Assistant Examiner*—Vladimir Imas

(57) ABSTRACT

A low profile electrical connector includes an insulative housing, a plurality of conductors in the housing, and a metal shell mounted in the housing. Two spaced flexible latches extend outward from either side of the shell. The latch includes a level portion having a top concave portion, and a solder leg extending downward from the level portion and having a curved portion extending from the concave portion to the solder leg. The housing and the shell together are mounted at a recess on an edge of a printed circuit board (PCB) by inserting the solder legs into a plurality of first holes of the PCB and inserting poles of the housing into a plurality of second holes of the PCB respectively with the level portions rested upon the PCB. Thus, height of the connector mounted on the PCB is greatly reduced.

2 Claims, 3 Drawing Sheets

LOW PROFILE ELECTRICAL CONNECTOR

This is a continuation-in-part of U.S. patent application Ser. No. 11/440,445, filed on May 25, 2006 now abandoned in the name of Chien-Chiu, CHEN and entitled "LOW PROFILE ELECTRICAL CONNECTOR" is now pending.

BACKGROUND OF THE INVENTION

1. Field of the Invention

The present invention relates to a low profile electrical connector, particularly to an electrical connector in which parts of the connector is inlaid below the printed circuit board (PCB) to reduce the height or profile of the electronic device.

2. Description of Related Art

Universal series bus (USB) electrical connector has a function to adjust different kinds of signal input/output, it is also one of the electrical connectors universally used at present time for data transmission. In computer accessories or peripheral devices (such as, scanner, digital camera, keyboard and the like peripheral devices.), it mostly applies a USB electrical connector as the transmission interface. As shown in FIG. 1, which shows a conventional USB electrical connector 50, the solder legs of the electrical connector 50 are extended outward from the metal shell directly, when assembled to a printed circuit board (PCB) 60, it can't reduce the using height of the connector, the large structure of the connector occupies quite a large space in the electronic device, undoubtedly the volume of the electronic device is increased, which doesn't comply with the developing tendency of light-weight and small-size in existing electronic products.

U.S. Publication Application No. 2004/0180577 A1 discloses an electrical connector having members 31 for grounding only without the function of supporting the electrical connector on a circuit board.

Therefore, the conventional USB connector is necessary to be improved to meet the requirements.

SUMMARY OF THE INVENTION

It is a primary object of the present invention to provide a low profile electrical connector having flexible enhanced components securely inserted into a PCB for reducing height of the electrical connector mounted on the PCB.

To achieve the above object, the present invention provides the following creative mechanism to achieve its functions. The low profile connector comprises an insulative housing, a plurality of electrical terminals and a metal shell wherein the insulative housing including a seat, a mating portion extending forwardly from the seat and having a plurality of parallel troughs, a first groove on an upper surface of the seat, two spaced second grooves on a lower surface of the seat, two spaced cavities in a rear of the second grooves, two arms extending rearward from two rear corners of the seat and each having a pole projecting downward, and a well on a rear end of the seat and having a plurality of through holes connecting to the corresponding troughs for disposing the conductors; and the rectangular metal shell including a first surface having a first latching portion, a second surface having two second latching portions, two sides each interconnecting the first and second surfaces, and two spaced flexible latches extending outward from either side, the latch including a level portion having a top concave portion, and a solder leg extending downward from the level portion and having a curved portion extending from the concave portion to the solder leg; wherein the first latching portion is lockingly engaged with the first groove and the second latching portions are lockingly engaged with the second grooves and the cavities for securing the insulative housing to the metal shell; and the insulative housing and the metal shell together are mounted at a recess on an edge of a printed circuit board (PCB) by inserting the solder legs into a plurality of first holes of the PCB and inserting the poles into a plurality of second holes of the PCB respectively with the level portions rested upon the PCB.

The above and other objects, features and advantages of the present invention will become apparent from the following detailed description taken with the accompanying drawings.

DETAILED DESCRIPTION OF THE PREFERRED EMBODIMENTS

Figure 1:
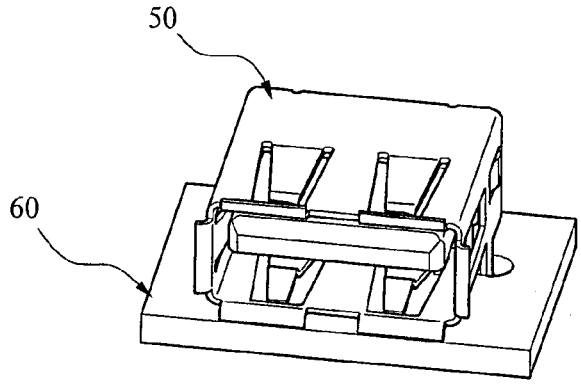
FIG. 1 is a perspective view of a conventional connector.
Figure 2:
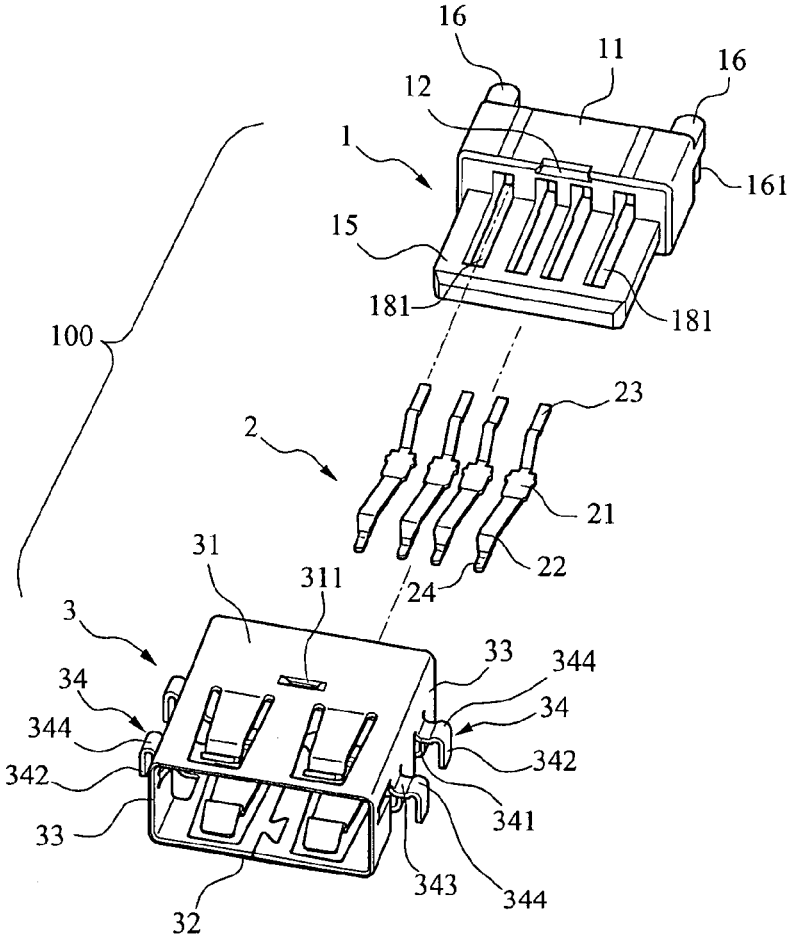
FIG. 2 is an exploded perspective view of a preferred embodiment of the present invention.
Figure 3:
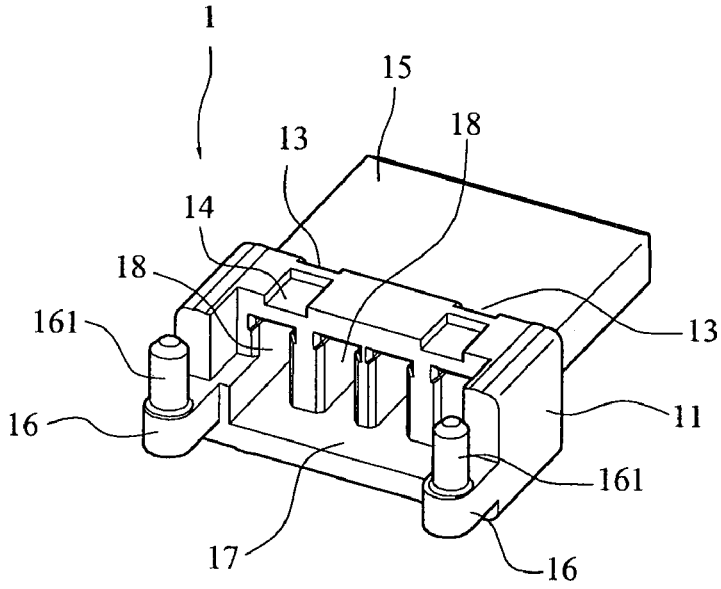
FIG. 3 is a perspective view of the insulative housing of the present invention from another angle.
Figure 4:
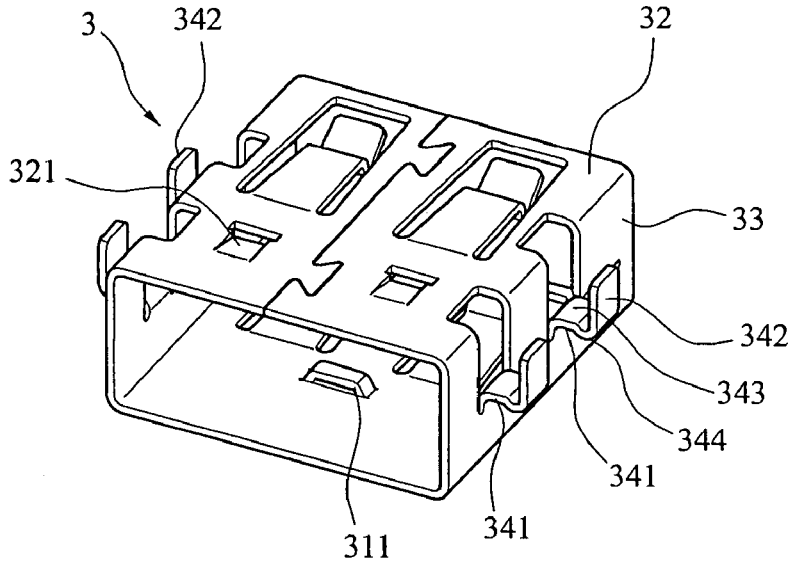
FIG. 4 is a perspective view of the metal shell of the present invention from another angle.

Refer to FIGS. 2 to 6, a preferred embodiment of a low profile electrical connector 100 of the present invention is shown. The low profile electrical connector 100 comprises an insulative housing 1, a plurality of conductors 2, and a metal shell 3. Each component is discussed in detail below.

The insulative housing 1 has a seat 11. On the upper surface of the seat 11, there is provided a first groove 12. On the lower surface of the seat 11, there are provided two spaced second grooves 13. Also, on the lower surface of the seat 11 there are provided two spaced cavities 14 in the rear of the second grooves 13. The seat 11 is formed with an outward extending mating portion 15 for securing to a connector (not shown). Two supporting arms 16 extend outward from the rear surface of the seat 11 and along two sides of the seat 11 respectively. On the lower surface of each supporting arm 16 there is provided a locating pole 161 for securing to a PCB 4. The rear of the seat 11 has a well 17. Within the well 17, there are provided a plurality of through holes 18 which extend to the mating portion 15 and further extend into troughs 181 for positioning the conductors 2.

The conductors 2 are inserted to the troughs 181 from the through holes 18 at the rear of the insulative housing 1. Each conductor 2 has a fixing portion 21, a solder portion 23 extending from an end of the fixing portion 21, a contact portion 22 extending from the other end of the fixing portion 21, and a restricting portion 24 further extending therefrom.

The metal shell 3 is stamped unitarily from a metal plate. The metal shell 3 is a rectangular structure including a first surface 31, an opposite second surface 32 and two sides 33 connected therebetween. A first latching portion 311 is formed on the first surface 31 and two second latching portions 321 are formed on the second surface respectively. Two spaced latches 34 extend outward from either side 33. The substantially inverted L-shaped latch 34 has a level portion 341 and a solder leg 342 extending downward from the level portion 341. In order to reforce the structural strength of the latch 34, a concave portion 343 is formed on a top of the level portion 341, and a curved portion 344 further extends from the concave portion 343 to the solder leg 342.

Figure 5:
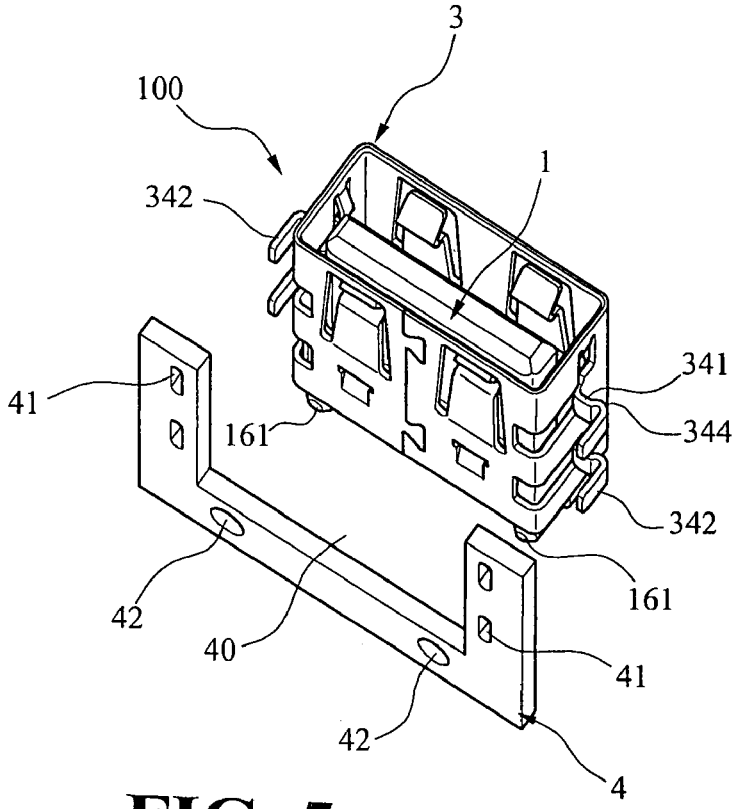
FIG. 5 is a perspective view showing the electrical connector of the present invention to be mounted on a PCB.

An assembly of the low profile electrical connector 100 of the present invention and the PCB 4 will be described in detail below. First, the conductors 2 are disposed within the troughs 181 from the through holes 18 on the rear of the insulative housing 1 to secure the terminal fixing portions 21 and the insulative housing 1 together. Next, the half-finished product is mounted in the metal shell 3 with the first latching portion 311 secured to the first groove 12 and the second latching portions 321 secured to the second grooves 13 and the cavities 14 respectively. Next, as shown in FIG. 5, the assembled electrical connector 100 is mounted at a recess 40 on an edge of the PCB 4 by inserting the locating poles 161 on the rear of the insulative housing 1 into second holes 42 of the PCB 4 and inserting the solder legs 342 of the metal shell 3 into first holes 41 on the PCB 4 respectively in which the latches 34 are flexibly deformed with the level portions 341 rested upon the PCB 4. In this position, the solder legs 342 are served as grounding legs. Moreover, the structural strength of the latch 34 is thus enhanced by the concave portion 343 and the curved portion 344 as mentioned above.

Figure 6:
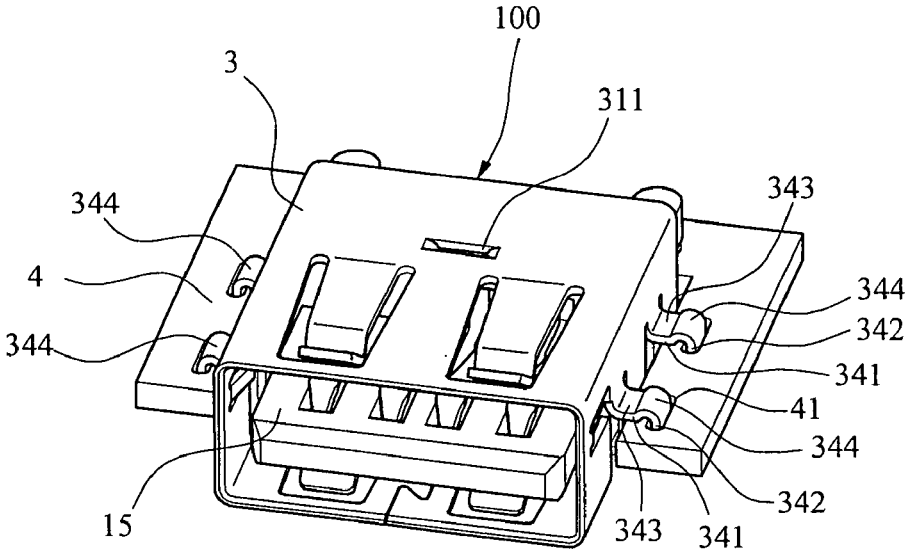
FIG. 6 is a perspective view showing the electrical connector of the present invention to be mounted on the PCB.

As shown in FIG. 6, about upper half portion of the electrical connector 100 is mounted under of the PCB 4. Thus, comparing to the conventional connectors, the electrical connector 100 of the present invention can reduce the height or profile of the product and save space. Therefore, it can reduce the size of an electronic device.

While the invention herein disclosed has been described by means of specific embodiments, numerous modifications and variations could be made thereto by those skilled in the art without departing from the scope and spirit of the invention set forth in the claims.

What is claimed is:

1. A low profile electrical connector comprising:

a plurality of conductors (2);

an insulative housing (1) including a seat (11), a mating portion (15) extending forwardly from the seat (11) and having a plurality of parallel troughs (181), a first groove (12) on a middle of an upper surface of the seat (11), each of two spaced second grooves (13) on a side portion of a front end of a lower surface of the seat (11), two spaced cavities (14) each on a side portion of a rear end of the lower surface of the seat (11) and the open side direction thereof opposite to that of the second grooves (13), two arms (16) each extending rearward from two rear corners of the seat (11) and each having a pole (161) projecting downward from an end of the arms (16), and a well (17) on a rear end of the seat (11) and having a plurality of through holes (18) communicating with the corresponding troughs (181) for disposing the conductors (2) therein; and a rectangular metal shell (3) including a first surface (31) having a first latching portion (311) disposed at a middle of the first surface (31) corresponding to the position of the first groove (12), a second surface (32) having two second latching portions (321) each disposed at a side portion of the second surface (32) corresponding to the position of the second grooves (13) and cavities (14), two sides (33) each interconnecting the first and second surfaces (31, 32), and two spaced flexible latches (34) extending outward from either side (33), the latch (34) including a level portion (341) having a top concave portion (343), and a solder leg (342) extending downward from the level portion (341) and having a curved portion (344) extending from the concave portion (343) to the solder leg (342); wherein upon assembling, the first latching portion (311) is lockingly engaged with the first groove (12) and the second latching portions (321) are lockingly engaged with the second grooves (13) and the cavities (14) for securing the insulative housing (1) to the metal shell (3); and the insulative housing (1) and the metal shell (3) together are mounted at a recess (40) on an edge of a printed circuit board (PCB) (4) by inserting the solder legs (342) into a plurality of first holes (41) of the PCB (4) and inserting the poles (161) into a plurality of second holes (42) of the PCB (4) respectively with a bottom of the level portions (341) firmly rested upon the PCB (4) to thereby lower a profile of the whole connector above the PCB.

2. The low profile electrical connector of claim 1, wherein each conductor (2) includes a fixing portion (21) provided at an inclined middle portion, a solder portion (23) extending from an end of the fixing portion (21) locating at a relatively higher position, a contact portion (22) extending from the other end of the fixing portion (21) locating at a relatively lower position, and a restricting portion (24) further extending from the contact portion (22) and toward the relatively lower position to thereby firmly fix to the through holes (18) and the troughs (181) therein.

* * * * *